US009833756B2

(12) United States Patent
Stöppler

(10) Patent No.: US 9,833,756 B2
(45) Date of Patent: Dec. 5, 2017

(54) APPARATUS FOR MIXING AND PUMPING

(71) Applicant: ALFA LAVAL CORPORATE AB, Lund (SE)

(72) Inventor: Andreas Stöppler, Speicher (CH)

(73) Assignee: ALFA LAVAL CORPORATE AB, Lund (SE)

( * ) Notice: Subject to any disclaimer, the term of this patent is extended or adjusted under 35 U.S.C. 154(b) by 756 days.

(21) Appl. No.: 14/348,333

(22) PCT Filed: Sep. 24, 2012

(86) PCT No.: PCT/EP2012/068742

§ 371 (c)(1),
(2) Date: Mar. 28, 2014

(87) PCT Pub. No.: WO2013/045381

PCT Pub. Date: Apr. 4, 2013

(65) Prior Publication Data

US 2014/0241108 A1 Aug. 28, 2014

(30) Foreign Application Priority Data

Sep. 30, 2011 (EP) ..... 11183495
Nov. 8, 2011 (EP) ..... 11188174

(51) Int. Cl.
*B01F 15/00* (2006.01)
*B01F 5/10* (2006.01)
(Continued)

(52) U.S. Cl.
CPC ..... *B01F 5/108* (2013.01); *B01F 3/1221* (2013.01); *B01F 5/102* (2013.01); *B01F 5/104* (2013.01);
(Continued)

(58) Field of Classification Search
CPC ..... B01F 3/12; B01F 3/04617; B01F 5/108; B01F 5/102; B01F 5/104
(Continued)

(56) References Cited

U.S. PATENT DOCUMENTS 4,660,990 A 4/1987 Svensson
4,850,704 A 7/1989 Zimmerly et al.
(Continued)

FOREIGN PATENT DOCUMENTS

CN 101274231 A 10/2008
DE 10 2007 032 228 A1 1/2009
(Continued)

OTHER PUBLICATIONS

Brochure describing Permix PC Series Inline Mixer/Shear Pump; PERMIX TEC Co. Ltd., date unknown but prior to Sep. 30, 2011. (5 pages).
(Continued)

*Primary Examiner* — Tony G Soohoo
*Assistant Examiner* — Anshu Bhatia
(74) *Attorney, Agent, or Firm* — Buchanan Ingersoll & Rooney PC

(57) ABSTRACT

An apparatus for mixing and pumping, the apparatus comprising a housing with an inlet and an outlet for receiving and expelling liquid and a material. The apparatus has a shear rotor and a stator for mixing the liquid and material and an impeller for pumping the liquid and material from the inlet, via an annular clearance between the shear rotor and the stator and to the outlet. The apparatus has a return conduit configured to return to the inlet a part of the liquid and material pumped via the annular clearance and openings in the stator.

17 Claims, 5 Drawing Sheets

(51) Int. Cl.

| | |
|---|---|
| ***B01F 7/00*** | (2006.01) |
| ***B01F 13/00*** | (2006.01) |
| ***B01F 15/02*** | (2006.01) |
| ***B01F 3/12*** | (2006.01) |
| *B01F 3/10* | (2006.01) |

(52) U.S. Cl.
CPC ..... *B01F 7/00708* (2013.01); *B01F 7/00775* (2013.01); *B01F 13/0032* (2013.01); *B01F 15/0202* (2013.01); *B01F 15/0243* (2013.01); *B01F 2003/105* (2013.01)

(58) Field of Classification Search
USPC ..... 366/182.2
See application file for complete search history.

(56) References Cited

U.S. PATENT DOCUMENTS

| | | | | |
|---|---|---|---|---|
| 5,322,357 | A | 6/1994 | Mazer | |
| 5,931,579 | A * | 8/1999 | Gallus | B01F 7/00766 366/163.2 |
| 7,048,432 | B2 | 5/2006 | Phillippi et al. | |
| 7,325,966 | B2 * | 2/2008 | Gassenschmidt | B01F 3/1221 366/136 |
| 7,331,540 | B2 * | 2/2008 | Klaumunzner | B01F 3/1221 241/188.2 |
| 2004/0223407 | A1 | 11/2004 | Gassenschmidt | |
| 2006/0016922 | A1 | 1/2006 | Klaumunzner | |
| 2011/0187099 | A1 | 8/2011 | Wittek | |

FOREIGN PATENT DOCUMENTS

| | | | |
|---|---|---|---|
| JP | 2006-281017 | A | 10/2006 |
| WO | WO 03/066203 | A1 | 8/2003 |
| WO | WO 2011/147958 | A1 | 12/2011 |

OTHER PUBLICATIONS

Brochure describing Permix PTC Series Powder Wetting & Dispersing Machine; PERMIX Co. Ltd., date unknown, but prior to Sep. 30, 2011. (2 pages).

International Search Report (PCT/ISA/210) dated Dec. 11, 2012, by the European Patent Office as the International Searching Authority for International Application No. PCT/EP2012/068742.

Written Opinion (PCT/ISA/237) dated Dec. 11, 2012, by the European Patent Office as the International Searching Authority for International Application No. PCT/EP2012/068742.

* cited by examiner

APPARATUS FOR MIXING AND PUMPING

TECHNICAL FIELD

The invention relates to an apparatus for mixing and pumping. The apparatus has a shear rotor, a stator and an impeller arranged in a housing for effecting the mixing and the pumping.

BACKGROUND ART

Today a number of techniques exist for inline mixing of a material and a liquid. Examples of materials include particles in e.g. powder form or granulate form, as well as liquids with significantly higher viscosity than the liquid to mix with. Inline mixing refers to continuously introducing the material in a stream of the liquid that the material shall be mixed with. The stream of liquid is typically generated by a pump and the material that is introduced in the stream must be adequately mixed with the liquid. The mixing may include that the material is dissolved in the liquid, either fully or in part. In either case, the material that is introduced into the stream is after its introduction transported as a part of the liquid.

The mixing is often affected by the rate of flow of the stream of liquid, which means that the design of both mixing equipment and pumping equipment must be considered in order to obtain adequate mixing.

Apparatuses with equipment for both mixing and pumping a liquid and material are disclosed in a number of patent documents, for example in U.S. Pat. Nos. 4,660,990, 4,850,704, 5,322,357 and US2004/0223407.

The disclosed apparatuses successfully accomplish mixing and pumping of liquid and material. However, they are quite bulky and they are not very versatile in respect of employment within in a wide range of processes where mixing is required.

SUMMARY

It is an object of the invention to at least partly overcome one or more of the above-identified limitations of the prior art. In particular, it is an object to provide an apparatus that accomplishes adequate mixing of a liquid and a material, as well as efficient feeding of the liquid, the material and the liquid and material after they have been mixed.

To fulfill these objects an apparatus for mixing and pumping is provided. The apparatus comprises: a housing with an inlet and an outlet for receiving and expelling liquid and a material; a shear rotor rotatably arranged in the housing about a central axis and connected to a drive unit; a stator fixedly arranged in the housing and surrounding a periphery of the shear rotor such that an annular clearance is formed between the shear rotor and the stator, wherein the liquid and material pass the annular clearance and through openings in the stator when the drive unit is activated, thereby effecting mixing of the liquid and material; and an impeller rotatably arranged in the housing about the central axis and connected to the drive unit, such that the impeller pumps the liquid and material from the inlet, via the annular clearance, via the openings in the stator and to the outlet when the drive unit is activated. The apparatus further comprises a return conduit that is configured to return to the inlet a part of the liquid and material that is pumped via the annular clearance and the openings in the stator. This means that a part of the liquid and material that have been mixed, i.e. a part of a mixture of the liquid and material, is returned to the inlet.

The provided apparatus is advantageous since it is, by virtue of the shear rotor, the stator and the impeller, readily employed as a single unit that performs both mixing and pumping. This renders the apparatus versatile since it may be easily employed within in a wide range of different processes. Moreover, the return conduit assists the employment within in a wide range of different processes because no external means are necessary in order to ensure proper receipt of unmixed liquid and material at the inlet, since returning a part of the mixed liquid and material to the inlet typically has the effect that the returned part pushes or pulls unmixed material and liquid towards the inlet. In this context, mixed liquid and material refers to liquid and material that has passed through the apparatus, while unmixed liquid and material is liquid and material that has not passed through the apparatus.

For the apparatus the pumping is performed by in particular the impeller. However, it is possible to give the rotor a shape such that it assists in the pumping. Correspondingly, the impeller may to some extent assist in mixing the liquid and material. Still, the main function of the impeller is the pumping, which includes generating a stream of liquid and material from the inlet to the outlet of the housing. Thus, the impeller draws liquid and material towards the inlet, past the annular clearance and the openings in the stator where mixing is effected, and to the outlet where the now mixed liquid and material are expelled.

The housing may comprise a further outlet to which the return conduit is connected for receiving the part of the liquid and material to return to the inlet, while a remaining part of the liquid and material is conveyed via the outlet. Alternatively or additionally, the return conduit may be connected to the outlet of the housing and may comprise a first branch that conveys the part of the liquid and material in a direction towards the inlet, and a second branch that conveys a remaining part of the liquid and material in another direction.

The return conduit may be configured to return to the inlet less than one third of the liquid and material pumped by the impeller. Returning more than one third is of course possible. However, returning more than one third does not appear to improve feeding of unmixed liquid and material to any larger extent, even if this may be the case. The liquid and material pumped by the impeller is the same liquid and material that is pumped via the annular clearance and the openings in the stator.

The shear rotor and the impeller may be arranged to rotate about a horizontal, geometrical axis. Additionally, the apparatus may comprise a horizontally arranged drive axle that connects the shear rotor and the impeller to the drive unit. These specific arrangements improve the feeding of in particular the material.

The apparatus may comprise a liquid conduit arranged to convey the liquid to the inlet, and a material conduit arranged to convey the material to the inlet, wherein the return conduit is connected to the material conduit, such that a flow of the material in the material conduit is facilitated by the part of the liquid and material that is returned by the return conduit.

The material conduit may comprise an outer conduit, an inner conduit and a chamber that is formed between the outer conduit and the inner conduit, the inner conduit being arranged to convey the material and the return conduit being connected to the chamber such that the chamber may receive the part of the liquid and material that is returned by the return conduit, the chamber comprising an opening that surrounds at least a part of an outlet of the inner conduit, such that the liquid and material returned by the return conduit pass through the opening and come into contact with and thereby transport material from the inner conduit. This particular embodiment is advantageous in that it provides quite efficient feeding of the material.

The material conduit may be connected to the liquid conduit, such that material from the material conduit is conveyed to the inlet of the housing via the liquid conduit.

The liquid conduit may have a horizontal extension such that it conveys liquid in a horizontal direction towards the inlet of the housing, and the material conduit may have a vertical extension such it conveys material in a vertical direction towards the liquid conduit. For this embodiment, the material conduit is, as seen in the vertical direction, connected to an upper side of the liquid conduit. Such connection improves the feeding of the material.

The material conduit may comprise a first manual valve and the liquid conduit may comprise a second manual valve. The valves are advantageous in that they provide an apparatus that may be employment as a single mixing and pumping unit within a wide range of different processes. The valves are also advantageous in that they may create pressure differences when they are opened and closed, which effectively facilitates feeding of material that might have got stuck e.g. in a liquid or material conduit leading to the inlet of the housing.

The apparatus may be mounted on a frame that comprises a number of wheels for transporting the apparatus. The frame with the wheels is advantageous since it assists in providing an apparatus that may be employment within a wide range of different processes, typically because of increased mobility. Moreover, the frame and wheels allows an operator to easily access various components of the apparatus from various sides, which is advantageous if e.g. material gets stuck somewhere and actions must be taken in order to facilitate proper feeding of material. Also, the wheels are advantageous in that the apparatus may be easily shaken for releasing material that has got stuck e.g. in a conduit leading to the inlet of the housing, which in turn facilitates proper feeding of material.

The apparatus may comprise a hopper that is connected to the material conduit, and a table that is arranged adjacent the hopper. The hopper and the frame assist in providing an apparatus that may be employment within a wide range of different processes, since they contribute to a increasing the apparatus capability to operate as a stand-alone unit. Also, both the hopper and the table facilitate proper feeding of the material. Typically, the hopper and the table may be supported by the frame.

The return conduit may be configured to return the part of the liquid and material to the inlet without passing the returned part of the liquid and material via any further pumping equipment. Thus, for this embodiment the return conduit may not be seen as a fluid line that incorporates a pump. The further pumping equipment is here any other pumping equipment that in addition to the apparatus would pump the liquid and material. Arrangements within the housing of the apparatus are however not considered to be a further pumping equipment.

BRIEF DESCRIPTION OF THE DRAWINGS

Embodiments of the invention will now be described, by way of example, with reference to the accompanying schematic drawings, in which.

DETAILED DESCRIPTION

Figure 1:
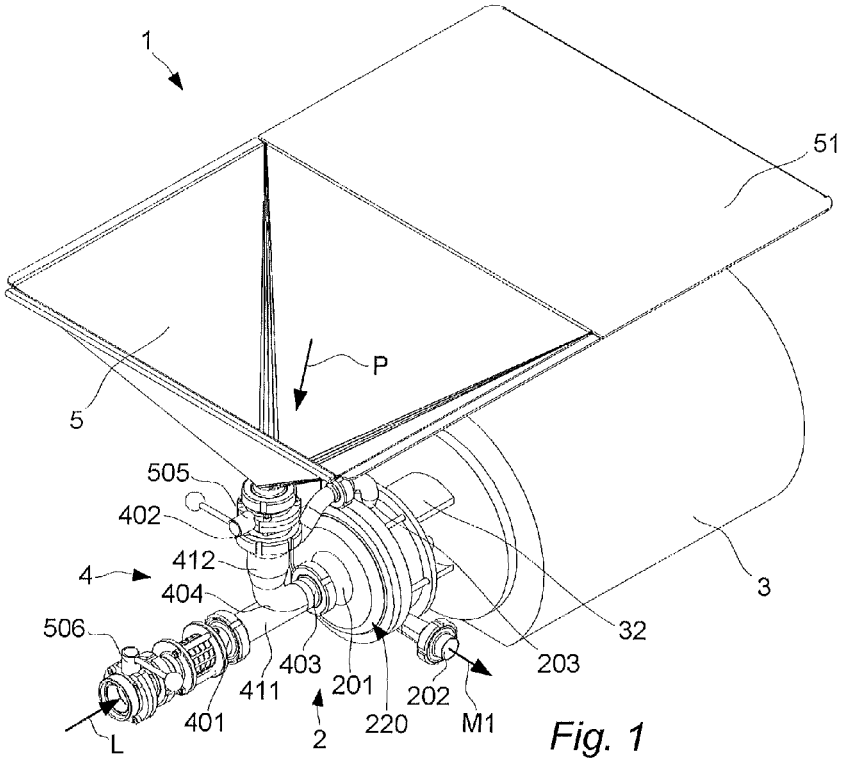
FIG. 1 is a perspective view of an apparatus for mixing and pumping.
Figure 2:
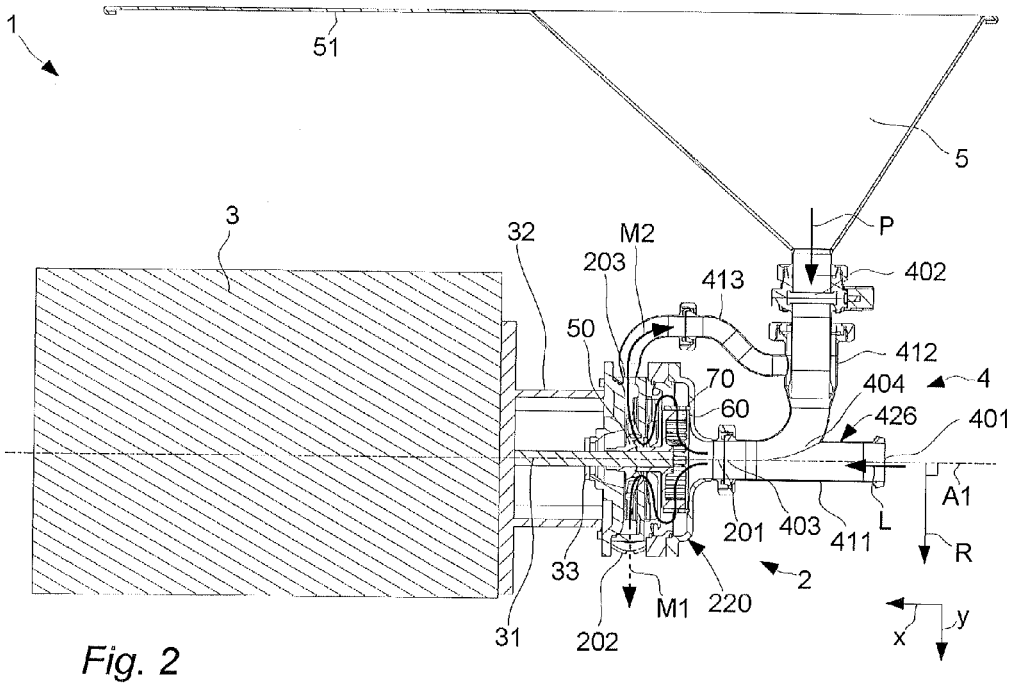
FIG. 2 is cross-sectional view of the apparatus of FIG. 1.

With reference to FIGS. 1 and 2 an apparatus 1 for mixing and pumping is shown. The apparatus 1 comprises a pump and mixing unit 2 and a piping arrangement 4. The apparatus effects mixing of a liquid L and a material P, where the material P typically is a dry material in powder or granulate form. The mixing may include dissolving the material P in the liquid L, either fully or in part. The material P may also have the form of a liquid with significantly higher viscosity than the liquid L to mix with. The pump and mixing unit 2 also effects pumping of the liquid L and material P prior they are mixed as well as pumping of the liquid L and material P after they have been mixed. When the liquid L and material P have been mixed, they are pumped in combination in the form of a mixture M1, M2. The piping arrangement 4 is connected to the pump and mixing unit 2 and ensures that liquid L and material P are effectively fed to the pump and mixing unit 2. In its most basic form the apparatus comprises the pump and mixing unit 2 and the piping arrangement 4, but may, as will be described, include additional components.

The pump and mixing unit 2 has an inlet 201 where both liquid L and material P are received. The liquid L and the material P are mixed in the pump and mixing unit 2 and a part M1 of the resulting mixture is expelled via an outlet 202, while, in one embodiment, another part M2 of the resulting mixture is expelled via a further outlet 203. The part M1 of the mixture expelled via the outlet 202 is referred to a "the process mixture" M1, while the other part M2 of the mixture is referred to as a "return mixture" M2. Typically, a flow of process mixture M1 that is expelled via the outlet 202 is twice as big as a flow of return mixture M2 that is expelled via the further outlet 203. In the illustrated embodiment the pump and mixing unit 2 comprises both the outlet 202 and the further outlet 203. The outlet 202 may be referred to as a first outlet and the further outlet 203 may be referred to as a second outlet.

The piping arrangement 4 comprises a material conduit 412 and a liquid conduit 411 that are joined at a joining section 404. In the shown embodiment this joining has been accomplished by connecting the material conduit 412 to an upper side 426 of the liquid conduit 411. The liquid conduit 411 has an inlet 401 for the liquid L and the material conduit 412 has an inlet 402 for the material P. The liquid L and the material P are brought together at the joining section 404 and are transported to an outlet 403 of the piping arrangement 4, which outlet 403 is connected to the inlet 201 of the pump and mixing unit 2. Even though the liquid L and the material P are brought together at the joining section 404 they are not considered to be mixed here, since bringing them together at the joining section 404 typically does not fulfill conventional requirements for adequate mixing. Thus, adequate mixing must be performed, which for the described embodiment is accomplished by the pump and mixing unit 2.

The piping arrangement 4 also comprises a return conduit 413 that is connected to the further outlet 203 and to the material conduit 412. The return conduit 413 conveys the return mixture M2 from the further outlet 203 and to the material conduit 412. Thus, the return mixture M2 is, together with the material P, brought together with the liquid L at the joining section 404 and is thereafter introduced in the pump and mixing unit 2 via the inlet 201. As will be described, the return mixture M2 effectively assists in feeding the material P to the joining section 404 as well as assists in feeding the liquid L and the material P to the inlet 201.

The pump and mixing unit 2 accomplishes mixing primarily by a shear rotor 60 and a stator 70 that is arranged about the shear rotor 60. Pumping is accomplished primarily by an impeller 50. However, depending on how the shear rotor 60 is embodied, it may assist more or less in the pumping. Correspondingly, the impeller 50 may assist in the mixing. The shear rotor 60, the stator 70 and the impeller 50 are arranged in the pump and mixing unit 2. In detail, the pump and mixing unit 2 comprises a housing 220 in which the shear rotor 60, the stator 70 and the impeller 50 are arranged. Typically, the housing 220 comprises the inlet 201 for the liquid L and material P, the outlet 202 for the process mixture M1, and the further outlet 203 for the return mixture M2. The liquid conduit 411 has a horizontal extension such that it may convey the liquid L a horizontal direction x towards the inlet 201 of the housing 220. The material conduit 412 has a vertical extension such it may convey the material P in a vertical direction y towards the liquid conduit 411.

Both the shear rotor 60 and the impeller 50 are rotatable arranged about a geometrical, central axis A1 and are connected to a horizontally arranged drive axle 31 that in turn is connected to a drive unit 3. The central axis A1 extends in a horizontal direction and defines a radial direction R. The drive unit 3 may have the form of e.g. a conventional, electrical motor. The pump and mixing unit 2 has a conventional gasket 33 arranged about the drive axle 31 at a location where it extends into the pump and mixing unit 2, such that leakage from the pump and mixing unit 2 is prevented. When the drive unit 3 is operated the drive axle 31, the shear rotor 60 and the impeller 50 rotates with the same rotational speed. A cover 32 is arranged about the drive axle 31 for preventing that the drive axle 31 is touched by e.g. an operator. The cover 32 also acts as a support that connects the pump and mixing unit 2 to the drive unit 3.

A hopper 5 is connected to the inlet 402 of the material conduit 412 for feeding the material P into the material conduit 412. A table 51 may be arranged adjacent the hopper 5 for e.g. more convenient handling material P that shall be fed into the hopper 5. Each of the drive axle 31, the drive unit 3 and the hopper 5 may be seen as comprised in the apparatus 1 for mixing and pumping.

A first manual valve 505 is arranged between the material conduit 412 and the hopper 5, which allows an operator to stop a flow of material P into the material conduit 412. A second manual valve 506 is connected to the inlet 401 of the liquid conduit 411. Typically, liquid L is introduced into the piping arrangement 4 by connecting a source of liquid (not shown) to the second manual valve 506. The second manual valve 506 allows an operator to e.g. stop a flow of liquid L into the liquid conduit 411, or to prevent that liquid L flows out from the piping arrangement 4 when a source of liquid is disconnected from the second manual valve 506.

Figure 3:
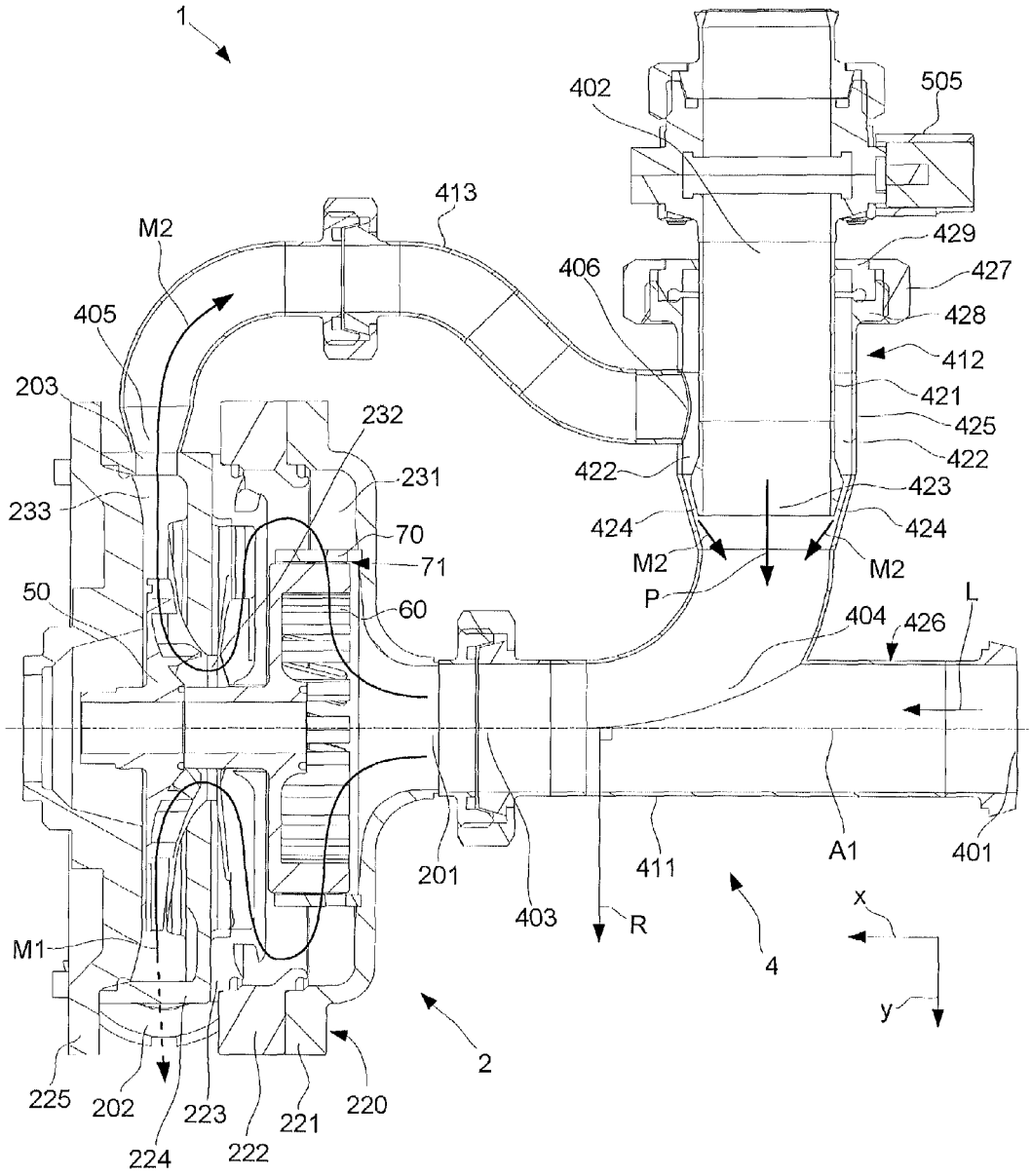
FIG. 3 is an enlarged, cross-sectional view the apparatus of FIG. 1, FIGS. 4-5 illustrate a stator of the apparatus of FIG. 1, FIGS. 6-7 illustrate a shear rotor of the apparatus of FIG. 1, FIGS. 8-9 illustrate an impeller of the apparatus of FIG. 1.
Figure 4:
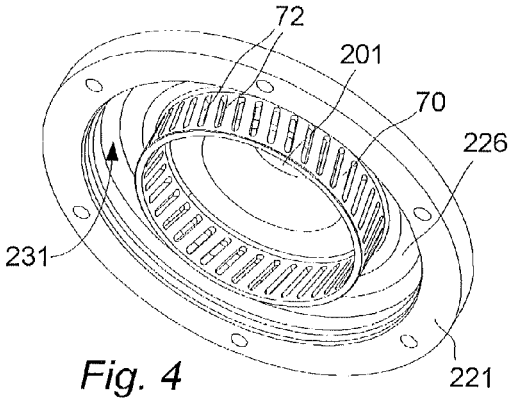

With reference to FIG. 3 an enlarged, cross-sectional view the apparatus 1 is illustrated. The pump and mixing unit 2 comprise the housing 220, which in turn comprises, as seen in a horizontal direction x, a front section 221, a first intermediate section 222, a second intermediate section 223, an impeller section 224 and a backsection 225. Of course, two or more of these sections 221-225 may be embodied as one, unitary section. The sections 221-225 are attached to each other, e.g. by welding them together or by using conventional bolts that extend from the frontsection 221 to the backsection 225 and hold the sections 221-225 together. In the illustrated embodiment, the impeller section 224 comprises the outlet 202 for the process mixture M1 and the further outlet 203 for the return mixture M2.

The further outlet 203 is embodied as an opening in the impeller section 224. The impeller section 224 comprises a corresponding opening for the outlet 202. The opening for the outlet 202 may not bee seen in FIG. 3 since it is arranged on the "backside" the cross-sectional view of FIG. 3. However, it is possible to arrange the opening for the outlet 202 directly opposite the further outlet 203 or at some other location in the impeller section 224.

The sections 221-225 form an interior space of the pump and mixing unit 2 and are, apart from the outlet 202 and the further outlet 203, symmetrical about the central axis A1. The stator 70, the shear rotor 60 and the impeller 50 are arranged in the interior space formed by the sections 221-225 and are symmetrically arranged about the central axis A1.

Figure 5:
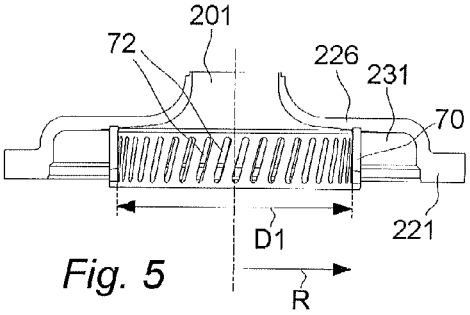
Figure 6:
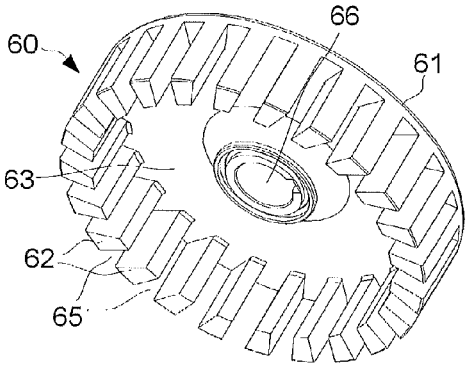

With further reference to FIGS. 5 and 6 the stator 70 is shown in detail. As may be seen, the stator 70 has the shape of a circular collar with an inner diameter D1. A number of openings 72 are evenly arranged in the stator 70 and the stator 70 is attached to a frontplate 226 of the frontsection 221. The openings 72 are embodied as elongated openings in the stator 70, but may also have the form of slits or cut-outs in the stator 70, typically on the side of the stator 70 that faces away from the frontsection 221.

Figure 7:
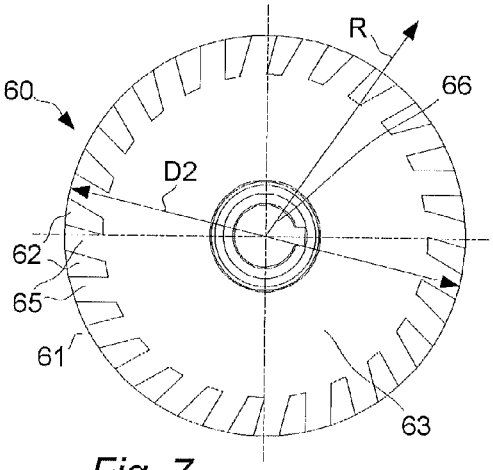
Figure 8:
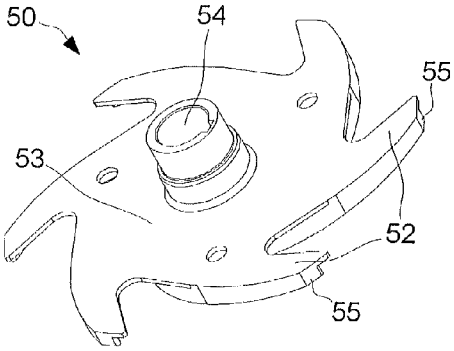

With further reference to FIGS. 7 and 8 the shear rotor 60 is shown in detail. The shear rotor 60 comprises a circular plate 63 with a centre hole 66 into which the drive axle 31 extends (see FIG. 2). The shear rotor 60 may be locked to the drive axle 31 by e.g. a small key (not shown) or by any other suitable means. At a periphery 61 of the plate 63 a number of teeth 62 are arranged. When the shear rotor 60 is arranged in the pump and mixing unit 2, the teeth 62 extends from the plate 63 in a direction towards the inlet 201, parallel to the central axis A1. As may be seen from the figures, the teeth 62 are separated by openings 65. The openings 65 have the form of interspaces 65 between the teeth 62. The shear rotor 60 is symmetrically arranged about the central axis A1 and the plate 63 of the shear rotor has a diameter D2 that is smaller then the inner diameter D1 of the stator 70. The teeth 62 of the shear rotor 60 are, as seen in the radial direction R, aligned with the stator 70 (see FIG. 3). Thus, an annular clearance 71 is formed between the stator 70 and the shear rotor 60, which allows the shear rotor 60 to rotate and liquid to pass through the interspaces 65, past the annular clearance 71 and through the openings 72 in the stator 70. When liquid L and material P pass between the interspaces 65 of the shear rotor 60 and the openings 72 of the stator 70 shear forces act on the material P in the liquid L, which effectively provides adequate mixing of the liquid L and material P. When the liquid L and the material P has passed the annular clearance 71 and the stator 70 they are conveyed through the pump and mixing unit 2 as a mixture M1, M2.

Instead of arranging teeth 62 that are separated by interspaces 65, a collar with openings (e.g. similar to the stator) may be arranged on the plate 63 of the shear rotor 60. However, the outer diameter D2 of the shear rotor 60 must always be smaller then the inner diameter D1 of the stator 70, such that the annular clearance 71 has a radial extension of that may be calculated as D1−D2.

Figure 9:
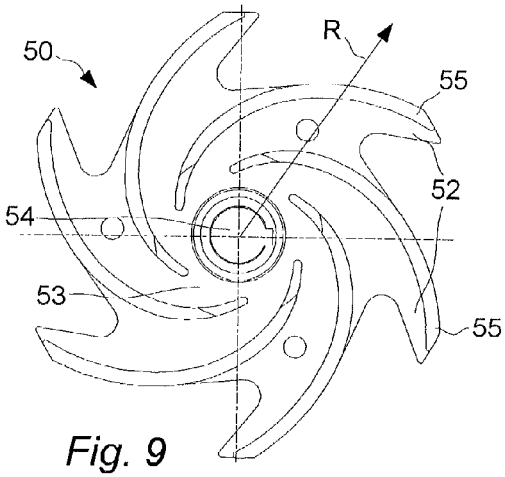
Figure 10:
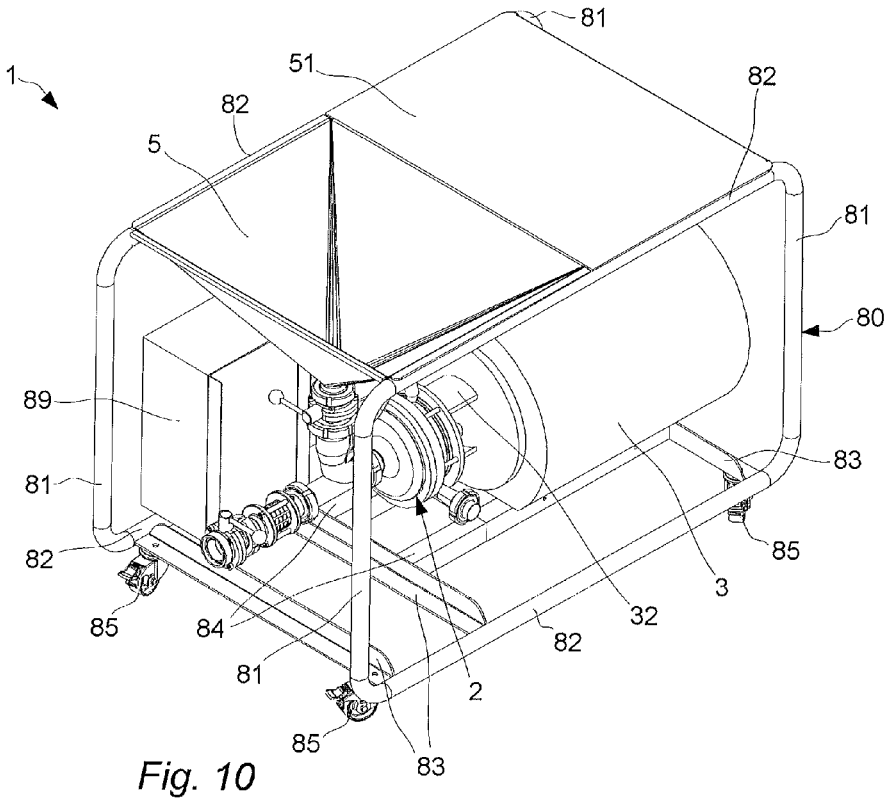
FIG. 10 is a perspective view of the apparatus of FIG. 1, when mounted on a frame with wheels.

With further reference to FIGS. 9 and 10 the impeller 50 is shown in detail. The impeller 50 comprises a plate 53 with a number of vanes 52. On the vanes 52 curved ridges 55 are arranged, such that each vane has a respective curved ridge. The impeller 50 is symmetrical about a centre hole 54 through which the drive axle 31 extends (see FIG. 2). The impeller 50 may be locked to the drive axle 31 by e.g. a small key (not shown) or by any other suitable means. When the impeller 50 is arranged in the pump and mixing unit 2, the curved ridges 55 protrudes from the plate 53 an in a direction towards the inlet 201. The impeller 50 is, as seen in the direction towards the inlet 201, arranged behind the shear rotor 60 and stator 70, i.e. the shear rotor 60 and the stator 70 are arranged intermediate the inlet 201 and the impeller 50. The impeller 50 is symmetrical about the central axis A1 and performs the same function as an impeller in a conventional centrifugal pump.

Turning back to FIG. 3, the housing 220 of the pump and mixing unit 2 comprises a first peripheral chamber 231 that is, as seen in the radial direction R, located outside the stator 70. The first intermediate section 222 has basically the form of a ring and allows fluid to flow from the first peripheral, annular chamber 231 and in a direction towards the central axis A1 and to an annular passage 232 in the impeller section 224. The passage 232 is located near to the central axis A1 such that the mixture M1, M2 that passes the passage 232 comes into contact with the curved ridges 55 of the impeller 50 at a location close to the centre hole 54 of the impeller 50. Then, by rotating the impeller 50, a flow of mixture M1, M2 is generated since mixture M1, M2 entering the impeller 50 near to the central axis A1 is accelerated by the impeller 50 in an outward, radial direction R towards a second peripheral, annular chamber 233 that is formed by the impeller section 224 and backsection 225.

Since the outlet 202 and the further outlet 203 are located at the periphery of the impeller section 224, mixture M1, M2 that is accelerated by the impeller 50 exits the pump and mixing unit 2 at the outlets 202, 203, where a process part of the mixture M1, M2 is expelled from the outlet 202 as the process mixture M1, and where a return part of the mixture M1, M2 is expelled from the further outlet 203 as the return mixture M2.

The return mixture M2 is expelled into an inlet 405 of the return conduit 413 and is conveyed, by the return conduit 413, to an outlet 406 of the return conduit 413. The outlet 406 of the return conduit 413 is connected to the material conduit 412. In detail, the material conduit 412 comprises an outer conduit 425 and an inner conduit 421. The return conduit 413 is connected to the outer conduit 425 and the outer conduit 425 is at a first of its ends connected to the liquid conduit 411. Specifically, the outer conduit 425 is joined to the liquid conduit 411 at the joining section 404, at the upper side 426 of the liquid conduit 411. At a second end of the outer conduit 425 the inner conduit 421 is inserted. The inner conduit 421 is attached to the outer conduit 425 by a threaded ring 427 that presses a flange 429 of the inner conduit 421 towards a threaded flange 428 of the outer conduit 425, when the threaded ring 427 is screwed onto the threaded flange 428.

The inner conduit 421 has an outer circumference that is smaller than an inner circumference of the outer conduit 425. Thus, an annular chamber 422 is formed between the outer conduit 425 and inner conduit 421, and the return mixture M2 transported by the return conduit 413 is introduced into the chamber 422. The chamber 422 has an opening 424 in form of an annular slit that is located at an outlet 423 of the inner conduit 421. Thus, when the return mixture M2 is continuously fed to the chamber 422, the return mixture M2 passes through the chamber 422 and exits the chamber 422 at the opening 424. Material P is introduced into the inlet 402 of the piping arrangement 4, which inlet 402 is an inlet of the inner conduit 421. Hence, when material P passes into the inner conduit 421 and further to the outlet 423 of the inner conduit 421, the material P meets the return mixture M2 where the opening 424 of the chamber 422 meets the outlet 423 of the inner conduit 421. As a result a kind of venturi effect is obtained, where the return mixture M2 assists in feeding the material P into the liquid conduit 411. This is advantageous in that there is a reduced risk of clogging of material P.

With reference to FIG. 10 an alternative embodiment of the apparatus 1 is illustrated. In this embodiment the apparatus 1 is mounted on a frame 80 that comprises a number of wheels 85. The apparatus 1, which thus comprises the frame 80 and wheels 85, may then easily be transported and used at a location where it is needed.

The frame 80 comprises two rectangular frames that are made of vertical bars 81 and horizontal bars 82. These frames form two longsides of the frame 80 and are at their lower ends held together by a first set of horizontal bars 83 and a second set of horizontal bars 84. The drive unit 3 is mounted on the second set of horizontal bars 84 and the cover 32 that is attached to the drive unit 3 supports the pump and mixing unit 2. The hopper 5 and the table 51 are supported by upper sides of the two rectangular frames formed by the vertical and horizontal bars 81, 82. The hopper 5 and the table 51 typically assist in holding the frame 80 together, e.g. by being welded or bolted to the frame 80. A control unit 89 is mounted on the frame 80 and the first set of horizontal bars 83. The control unit 89 is connected to the drive unit 3 and is arranged to control at least activation, deactivation and a rotational speed of the drive unit 3.

As may be seen from the figures, the return conduit 413 is configured to return the return mixture M2 to the inlet 201 without passing the return mixture M2 via any other further pumping equipment.

During operation of the apparatus 1 a source of liquid is connected to the second manual valve 506, material is fed into the hopper 5 and further past the first manual valve 505, and a receptacle or mixture-conveying piping is connected to the outlet 202. Any suitable source of liquid and receptacle or mixture-conveying piping may be used as long as they may convey liquid to the apparatus 1 respectively receive a mixture from the apparatus 1. However, additional mixing or pumping equipment is not required for achieving adequate mixing and pumping or for ensuring that liquid and material are efficiently fed by the apparatus 1.

Mixing and pumping is performed by the apparatus 1 alone when the drive unit 3 is activated and effects a rotation of the drive axle 31, the impeller 50 and the shear rotor 60. The rotation of the impeller 50 generates a suction at the inlet 201 such that the liquid L and the material P is "pulled"

into the inlet 201. The liquid L and material P is then pulled further past the shear rotor 60, past the annular clearance 71 and past the stator 70 which effects mixing of the liquid L and material P, such that the liquid L and material P becomes mixed and forms a mixture M1, M2. The mixture M1, M2 is then pulled further towards the impeller 50 where it is accelerated towards the outlet 202 and the further outlet 203. The part of the mixture M1 that exits via the outlet 202 is "pushed" or conveyed to a suitable receptacle or mixture-conveying piping, and is referred to as the process mixture M1. The part of the mixture M2 that exits via the further outlet 203 is, via the return conduit 413, "pushed" or conveyed to the chamber 422, and is referred to as the return mixture M2. The return mixture M2 assists in pulling the material P out from the inner conduit 421 and thereafter assists in pushing the material P as well as liquid L in the liquid conduit 411 towards the inlet 201. The pushing or pulling of liquid and material may also be referred to as "feeding" the liquid and material.

For obtaining a suitable pushing or pulling effect on the liquid L and the material P up to one third of the mixture M1, M2 may be returned as the return mixture M2. Thus, at least two thirds of the mixture M1, M2 is advantageously fed as the process mixture M1. Other embodiments of the apparatus 1 may require different proportions between the return mixture M2 and process mixture M1, and may be empirically determined for obtaining adequate feeding and mixing.

During operation liquid L is continuously fed into the liquid conduit 411 and material P is continuously fed into the hopper 5. As a result, material is continuously mixed with liquid that flows in a steady stream, which may referred to as so called inline mixing.

Figure 11:
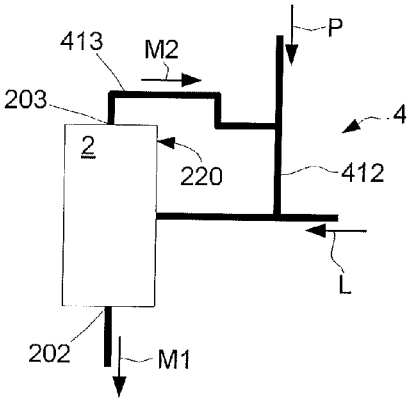
FIG. 11 is a schematic view of the apparatus of FIG. 1, and FIGS. 12-13 are schematic views of further embodiments of an apparatus for mixing and pumping.
Figure 12:
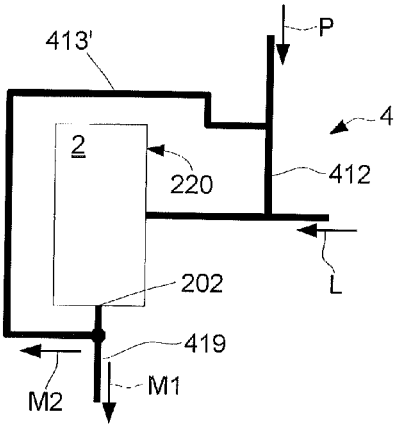

With reference to FIG. 11 a schematic drawing of the described apparatus 1 is shown. A second embodiment of the apparatus 1 is schematically illustrated by FIG. 12. The second embodiment differs from the previous one in that the further outlet 203 is omitted and in that the return conduit 413' is connected to the outlet 202 via a connection point that is located downstream the outlet 202. The connection point may be embodied as conventional flow divider, such that a predetermined part M2 of the mixture enters the return conduit 413' where it is conveyed as the return mixture M2, while a remaining part M1 of the mixture is conveyed by a conduit 419 as the process mixture M1. In this embodiment the return conduit 413' may be seen as comprising a first branch 413' and a second branch 419, where the first branch 413' conveys a part M2 of the mixture in a direction towards the inlet 201, while the second branch 419 conveys a remaining part M1 of the mixture in another direction.

Figure 13:
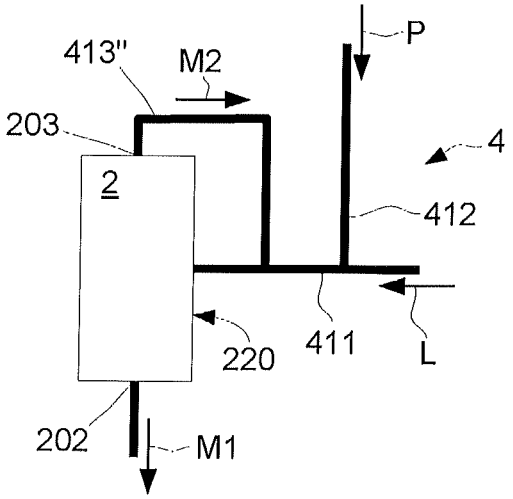

With reference to FIG. 13 a third embodiment of an apparatus 1 for pumping and mixing is shown. The third embodiment differs from the embodiment of FIGS. 1-3 in that a return conduit 413" is connected from the further outlet 203 and directly to the liquid conduit 411. This allows the return mixture M2 to push the liquid L in a direction towards the pump and mixing unit 2. This is, in comparison to not returning any return mixture M2 to the inlet 201, advantageous in that the feeding of the liquid L is improved. Improved feeding of liquid L improves in turn feeding of material P towards the pump and mixing unit 2, since the liquid L draws the material P.

From the description above follows that, although various embodiments of the invention have been described and shown, the invention is not restricted thereto, but may also be embodied in other ways within the scope of the subject-matter defined in the following claims. In particular, the return conduit may be connected in several ways to the pump and mixing unit, as long as it somehow returns the return mixture to the inlet of the pump and mixing unit.

The invention claimed is:

1. An apparatus for mixing and pumping, the apparatus comprising:

a housing with an inlet and an outlet for receiving and expelling liquid and a material, a shear rotor rotatably arranged in the housing about a central axis and connected to a drive unit, a stator fixedly arranged in the housing and surrounding a periphery of the shear rotor such that an annular clearance is formed between the shear rotor and the stator, wherein the liquid and material pass the annular clearance and through openings in the stator when the drive unit is activated, thereby effecting mixing of the liquid and material, an impeller rotatably arranged in the housing about the central axis and connected to the drive unit, such that the impeller pumps the liquid and material from the inlet, via the annular clearance, via the openings in the stator and to the outlet when the drive unit is activated, a liquid conduit arranged to convey the liquid to the inlet, a material conduit arranged to convey the material to the inlet, a return conduit configured to return to the inlet a part of the liquid and material pumped via the annular clearance and the openings in the stator, the return conduit being connected to the material conduit such that flow in the material conduit is facilitated by the part of the liquid and material returned through the return conduit, and the material conduit being connected to the liquid conduit such that material from the material conduit is conveyed to the inlet via the liquid conduit.

2. An apparatus according to claim 1, wherein the housing comprises a further outlet to which the return conduit is connected for receiving the part of the liquid and material to return to the inlet, while a remaining part of the liquid and material is conveyed via the outlet.

3. An apparatus according to claim 1, wherein the return conduit is connected to the outlet of the housing and comprises:

a first branch that conveys the part of the liquid and material in a direction towards the inlet, and a second branch that conveys a remaining part of the liquid and material in another direction.

4. An apparatus according to claim 1, wherein the return conduit is configured to return to the inlet less than one third of the liquid and material pumped by the impeller.

5. An apparatus according to claim 1, wherein the shear rotor and the impeller are arranged to rotate about a horizontal, geometrical axis.

6. An apparatus according to claim 5, comprising a horizontally arranged drive axle that connects the shear rotor and the impeller to the drive unit.

7. An apparatus according to claim 1, wherein the material conduit comprises an outer conduit, an inner conduit and a chamber that is formed between the outer conduit and the inner conduit, the inner conduit being arranged to convey the material and the return conduit being connected to the chamber such that the chamber may receive the part of the liquid and material returned by the return conduit, the chamber comprising an opening that surrounds at least a part of an outlet of the inner conduit, such that the liquid and material returned by the return conduit pass through the opening and come into contact with and thereby transport material from the inner conduit.

8. An apparatus according to claim 1, wherein the liquid conduit has a horizontal extension such that it conveys liquid in a horizontal direction towards the inlet of the housing, and the material conduit has a vertical extension such it conveys material in a vertical direction towards the liquid conduit, and is, as seen in the vertical direction, connected to an upper side of the liquid conduit.

9. An apparatus according to claim 1, wherein the material conduit comprises a first manual valve and the liquid conduit comprises a second manual valve.

10. An apparatus according to claim 1, wherein the apparatus is mounted on a frame that comprises a number of wheels for transporting the apparatus.

11. An apparatus according to claim 1, comprising:

a hopper that is connected to the material conduit, and a table arranged adjacent the hopper.

12. An apparatus according to claim 11, wherein the hopper and the table are supported by the frame.

13. An apparatus according to claim 1, wherein the return conduit is configured to return the part of the liquid and material to the inlet without passing the returned part of the liquid and material via any further pumping equipment.

14. An apparatus for mixing and pumping, the apparatus comprising:

a housing with an inlet for receiving a liquid and a material, and an outlet for expelling the liquid and the material, the housing possessing an interior;

a hopper configured to receive the material;

a material conduit possessing one open end connected to the hopper and an opposite open end connected to the inlet so that the material in the hopper enters the material conduit and is conveyed along the material conduit to the inlet;

a shear rotor rotatably arranged in the interior of the housing to rotate about a central axis and connected to a drive unit;

a stator fixedly arranged in the interior of the housing and surrounding a periphery of the shear rotor such that an annular clearance exists between the shear rotor and the stator;

the stator and the shear rotor being positioned within the housing relative to the inlet and the outlet such that the liquid and the material entering the housing by way of the inlet pass the annular clearance and also pass through openings in the stator when the drive unit is activated to thereby mix the liquid and material and produce mixed liquid and material;

an impeller rotatably arranged in the interior of the housing to rotate about the central axis and connected to the drive unit to pump the liquid and the material from the inlet to the outlet by way of the annular clearance and the openings in the stator when the drive unit is activated; and a return conduit possessing one end which opens into the material conduit and an opposite end which opens into the interior of the housing so that a part of the mixed liquid and material is conveyed along the return conduit and introduced into the material conduit at a position between the hopper and the inlet so that the mixed liquid and material is conveyed along the material conduit to the inlet and facilitates flow in the material conduit.

15. An apparatus according to claim 14, wherein the hopper includes an interior possessing a tapering shape that narrows in size toward a bottom end of the hopper, the one open end of the material conduit being connected to the bottom end of the hopper.

16. An apparatus according to claim 14, wherein the outlet is one outlet and the housing comprises a further outlet different from and spaced from the one outlet, the opposite end of the return conduit being connected to the further outlet, the part of the mixed liquid and material that is conveyed through the further outlet and into the return conduit being a first part of the mixed liquid and material, the mixed liquid and material also including a second part that passes through the one outlet and is kept separate from the first part of the mixed liquid and material.

17. An apparatus according to claim 14, wherein the central axis about which the shear rotor and the impeller rotate is a horizontal axis.

* * * * *